US009915125B2

(12) United States Patent
Van Clief et al.

(10) Patent No.: US 9,915,125 B2
(45) Date of Patent: Mar. 13, 2018

(54) WELLBORE STRINGS CONTAINING ANNULAR FLOW VALVES AND METHODS OF USE THEREOF

(71) Applicants: Rockni Van Clief, Houston, TX (US); Kelly D. Ireland, Conroe, TX (US); Christian F. Bayne, The Woodlands, TX (US); David A. Bilberry, Houston, TX (US); David S. Bishop, Houston, TX (US); Kirby Glen Schrader, Magnolia, TX (US)

(72) Inventors: Rockni Van Clief, Houston, TX (US); Kelly D. Ireland, Conroe, TX (US); Christian F. Bayne, The Woodlands, TX (US); David A. Bilberry, Houston, TX (US); David S. Bishop, Houston, TX (US); Kirby Glen Schrader, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 630 days.

(21) Appl. No.: 14/299,932

(22) Filed: Jun. 9, 2014

(65) Prior Publication Data

US 2015/0354317 A1 Dec. 10, 2015

(51) Int. Cl.

| | |
|---|---|
| ***E21B 43/14*** | (2006.01) |
| ***E21B 34/10*** | (2006.01) |
| ***E21B 17/18*** | (2006.01) |
| ***E21B 34/14*** | (2006.01) |

(52) U.S. Cl.

CPC ..... *E21B 34/10* (2013.01); *E21B 17/18* (2013.01); *E21B 34/103* (2013.01); *E21B 34/14* (2013.01); *E21B 43/14* (2013.01)

(58) Field of Classification Search

CPC ..... E21B 34/10; E21B 34/108; E21B 34/12; E21B 34/14; E21B 43/14; E21B 17/18

See application file for complete search history.

(56) References Cited

U.S. PATENT DOCUMENTS

| | | | | |
|---|---|---|---|---|
| 7,124,824 | B2 | 10/2006 | Turner et al. | |
| 7,201,232 | B2 | 4/2007 | Turner et al. | |
| 7,665,526 | B2 | 2/2010 | Turner et al. | |
| 2004/0020652 | A1 * | 2/2004 | Campbell | E21B 34/10 166/313 |

* cited by examiner

*Primary Examiner* — David J Bagnell
*Assistant Examiner* — Ronald R Runyan
(74) *Attorney, Agent, or Firm* — Cantor Colburn LLP

(57) ABSTRACT

An apparatus for use in a wellbore contains a flow control device for use in a wellbore that includes a bore that provides a first flow path and a second flow path via an annulus around the first flow path. The apparatus further includes a closing device that closes the second flow path when the closing device is mechanically moved in a first direction and an opening device that opens the second flow path when a fluid under pressure is supplied to the annulus when a valve is closed.

19 Claims, 4 Drawing Sheets

WELLBORE STRINGS CONTAINING ANNULAR FLOW VALVES AND METHODS OF USE THEREOF

BACKGROUND

1. Field of the Disclosure

This disclosure relates generally to completion strings deployed in multi-zone production wellbores that include valves for separately flowing formation fluids from different zones.

2. Background

Wellbores are drilled in subsurface formations for the production of hydrocarbons (oil and gas). Modern wells can extend to great well depths, often more than 15,000 ft. Hydrocarbons are trapped in various traps or zones in the subsurface formations at different depths. Such zones are referred to as reservoirs or hydrocarbon-bearing formations or production zones. In a multi-zone well bore, it is often desired to flow the formation fluid separately from two or more zones. Valves, generally, referred to annular valves, have been used that include a central flow path and an annular flow path to provide concentric fluid flow paths from different zones. Such valves, typically, are conveyed in the wellbore with the annular path open. The annular flow path is closed downhole to perform pressure tests and then opened hydraulically by applying pressure in the central flow path.

The disclosure herein provides a production string that includes an annular valve, wherein an annular flow path may be closed and opened mechanically or opened hydraulically by supplying a fluid to the annular flow path.

SUMMARY

In one aspect, an apparatus for use in a wellbore is disclosed that in one non-limiting embodiment contains a flow control device for use in a wellbore that includes a bore that provides a first flow path, a second flow path in an annulus around the first flow path, a closing device that closes the second flow path when the closing device is mechanically moved in a first direction and an opening device that opens the second flow path when a fluid under pressure is supplied to the annulus when the valve is closed.

In another aspect, a method of completing a wellbore is disclosed that in one non-limiting embodiment includes: providing a string in the wellbore that includes a first tubing that carries a first fluid from a first zone in the wellbore and a second tubing that carries a second fluid from a second zone in the wellbore; placing a valve in the string that includes a first flow path for allowing the first fluid to flow through a first flow path in the valve and a second flow path in an annulus of the valve that allows flow of the second fluid through the second flow path in the annulus, wherein the valve further comprises, a closing device that closes the second flow path when the closing device is mechanically moved in a first direction, and an opening device that opens the second flow path when a fluid under pressure is supplied to the annulus when the valve is closed; placing the string in the wellbore to cause the first fluid to flow through first flow path and the second fluid to flow through the second flow path in the annulus; closing the valve by mechanically moving the closing device in the first direction; pressure testing the valve; and opening the valve by supplying a fluid under pressure to the annulus. In another aspect, the method further includes producing the first fluid from the first zone via the first flow path and producing the second fluid from the second zone via the second flow path.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
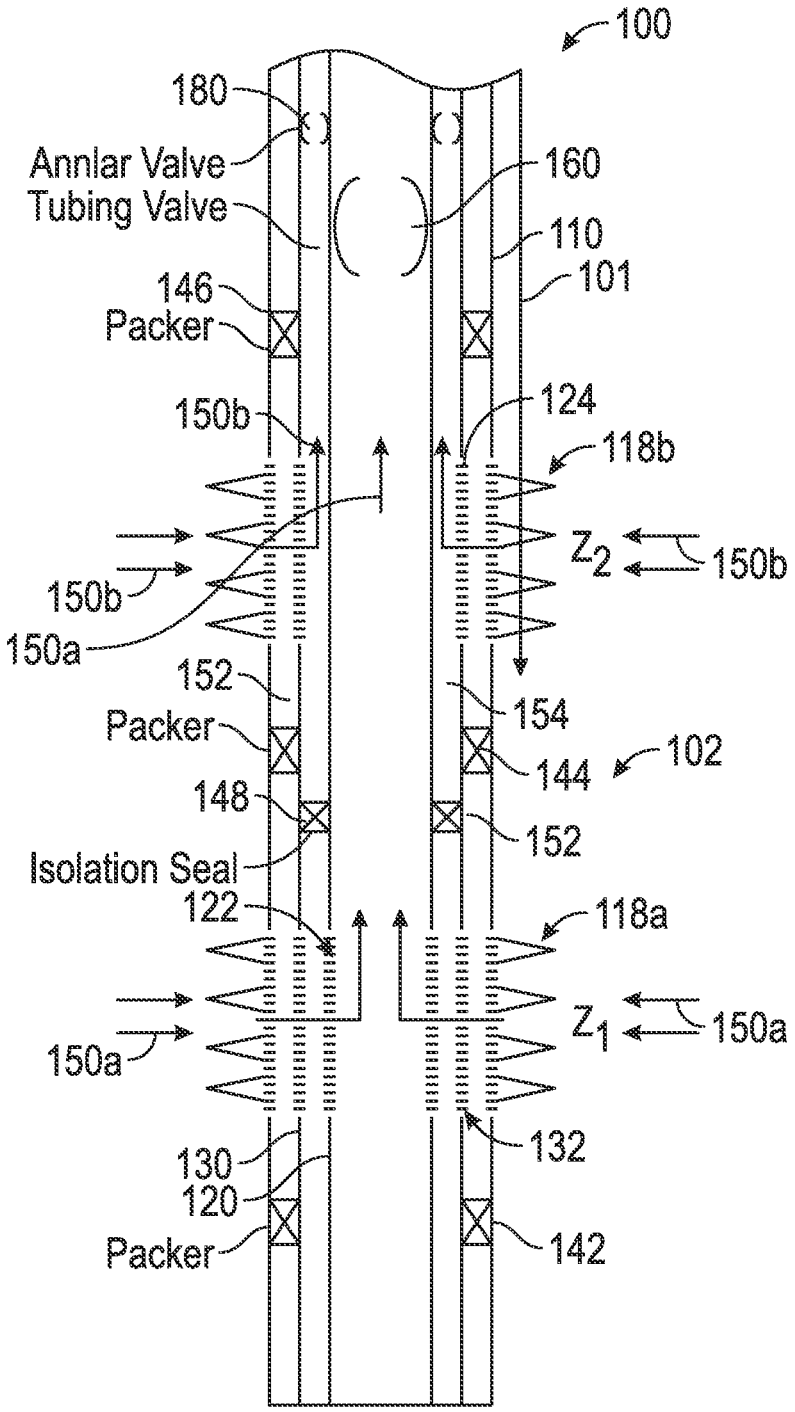
FIG. 1 shows an exemplary cased hole multi-zone wellbore containing a production string that includes an annular valve for separately producing fluids from two zones, according to one non-limiting embodiment of the disclosure.

FIG. 1 is a line diagram of a completion string or completion assembly 100 for the production of formation fluids from a multi-zone well, which completion assembly may include one or more flow control devices 180 (also referred to herein as a flow devices or annular valves) made according one or more or embodiments of this disclosure. The assembly 100 is shown to include a casing 110 deployed in wellbore 101 formed in a formation 102. The formation 102 includes a number of production zones, such zones Z1 and Z2. Perforations 118*a* and 118*b* respectively are formed through the casing 110 into zones Z1 and Z2 to flow the formation fluid 150*a* from zone Z1 into the casing and fluid 150*b* from zone Z2. The completion string 100 includes an inner pipe or tubular 120 and an outer pipe 130. The outer pipe 130 includes a sand screen 132 proximate to the zone Z1 and the inner pipe 120 includes a sand screen 122 inside and proximate to the sand screen 132. The inner pipe also includes a sand screen 124 in front of the perforation 118*b* in Zone Z2. Packers 142 and 144 isolate the annulus 152 between the casing 110 and the outer pipe 130 above and below the perforations 118*a* in zone Z1, while packers 144 and 146 isolate the annulus 152 between the casing 110 and the outer pipe 130 above and below the perforation 118*b* in zone Z2. In addition, packer 148 isolates the annulus 154 between the inner pipe 120 and the outer pipe 130 above the zone Z1. In this manner, fluid 150*a* from zone Z1 flows only into the inner pipe 120 through the perforations 118*a*, sand screens 132 and 122 and fluid 150*b* from zone Z2 enters only into the annulus 154 above the zone Z2. Thus, in the string 100, fluid 150*a* from zone Z1 will flow uphole via the inner pipe 120 while fluid 150*b* from Zone Z2 will flow uphole via the annulus 154 between the inner pipe 120 and the outer pipe 130. The string 100 may further include a flow control device 160, such as a barrier valve, that can be closed to prevent the flow of the fluid 150*a* through the inner pipe 120. Any suitable flow control device known in the art may be utilized as the flow control device 160. The string 110 further includes one or more annular flow control devices 180 (also referred to herein as annular valves or valves) that may be selectively closed and opened to close and open flow of fluid 152*b* through the annulus 154. A non-limiting embodiment of a flow control device is described in reference to FIGS. 2-4.

Figure 2:
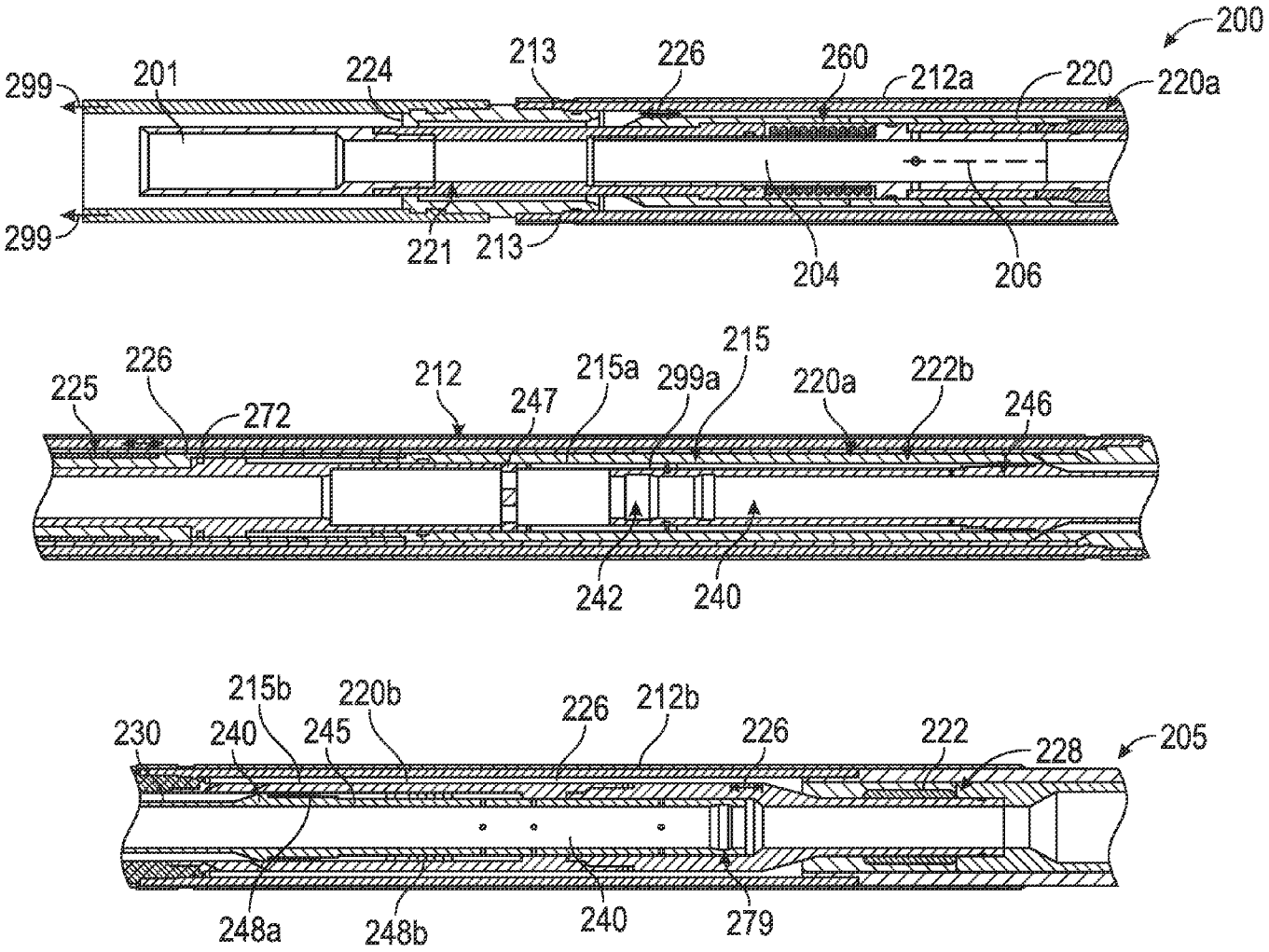
FIG. 2 shows the cross-section of a non-limiting embodiment of an annular valve in the run-in open position for placement in a production string, including the production string shown in FIG. 1, for deployment the a multi-zone wellbore, such as wellbore shown in FIG. 1.

FIG. 2 shows a cross-section of a non-limiting embodiment of an annular flow control device 200 in the run-in open position for use in a production string or assembly, including, but not limited to, string 110, shown in FIG. 1 for a multi-zone wellbore system 100. The annular valve 200 includes an upper seal bore 201 that connects to a tubular (not shown) above or uphole of the annular valve 200 and a bottom sub 205 that connects to a tubular (not shown) below or downhole of the annular valve 200. The annular valve 200 includes an outer housing 212 that includes of an upper outer housing or section 212*a* coupled to coupling 213 below the upper seal bore 201 and a lower outer housing or section 212*b* that terminates above the bottom sub 205. The coupling 213 connects to a tubular (not shown) above or uphole the annular valve 200. The annular valve 200 further includes a valve housing 215 that is generally placed inside the outer housing 212 to provide an annular flow path 220 between the outer housing 212 and the valve housing 215. The annular valve 200 has a through flow path or bore 204 along a central axis 206 that provides a continuous flow path for a fluid produced from one of the zones in the wellbore below the valve 200, as described in reference to FIG. 1 above. The valve 200 includes an annular space 221 outside the flow path 204 that provides the annular flow path 220 between the outer housing 212 and the valve housing 215. The annular flow path 220 runs from a fluid inlet or port 222 in the bottom sub 205 and between the lower valve housing 215*b* and the outer housing 212*b* to a fluid flow path 224 formed between the tubulars (not shown) above the upper seal bore 201 and the coupling 213 connected to the upper outer housing 212*a*. The annular flow path 220 is shown by arrows 226. The annular flow path continues above the valve within a tubular (not shown) connected to the coupling 213 and upper flow sub respectively, as shown by arrows 299. In the particular configuration of FIG. 2, the annular flow path 220 includes an upper annular flow path 220*a*, a lower annular flow path 220*b* and an annular bypass 230 formed between the lower end of the upper valve housing 215*a* and a device or valve mandrel 240, as described in more detail below. The valve mandrel 240, in one position allows fluid flow through the annular bypass 230 and thus through the annular flow path 220 and in another position obstructs or closes the annular bypass 230 to close the annular flow path 220. In the valve position shown in FIG. 2, the annular flow path 220 is open and thus will allow a fluid 228 entering the inlet port 222 to flow through the annular space 220 to the fluid flow path 224. The annular flow path 220 shown in FIG. 2 is referred to as "open". Thus, in aspects, the flow control device 200 includes a central flow path 204 that is open for allowing flow of a fluid therethrough and an annular flow path 220 that may be selectively opened and closed to flow another fluid therethrough.

Still referring to FIG. 2, the valve mandrel 240, in one aspect, is a movable device that may be mechanically-operated or moved inside the valve housing 215 to close and open the annular bypass 230, thereby closing and opening the annular flow path 220. The valve 200 further includes a hydraulic device or mechanism 260 for opening the annular bypass 230. The valve mandrel 240 includes an upper latch profile 242 that may be connected to a suitable shifting tool (not shown) to shift (move) the valve mandrel 240 uphole (to the left in FIG. 2) to close the annular bypass 230 or move or push the valve mandrel 240 downhole (to the right in FIG. 2) to open the annular bypass 230. The valve mandrel 240 further includes an upper seal stack or seal 246 and lower seal stacks or seals 248*a* and 248*b* that provide seals between the valve mandrel 240 and the valve housings 215*a* and 215*b*. The flow path 220*a* remains in fluid communication with the fluid in the wellbore uphole of the valve 200 when the annular bypass 230 is closed. The method of closing and opening the annular bypass 230 and thus the annular flow path 220 by the device 240 is described below first and then opening of the annular flow path 220 by the hydraulic device 260.

Figure 3:
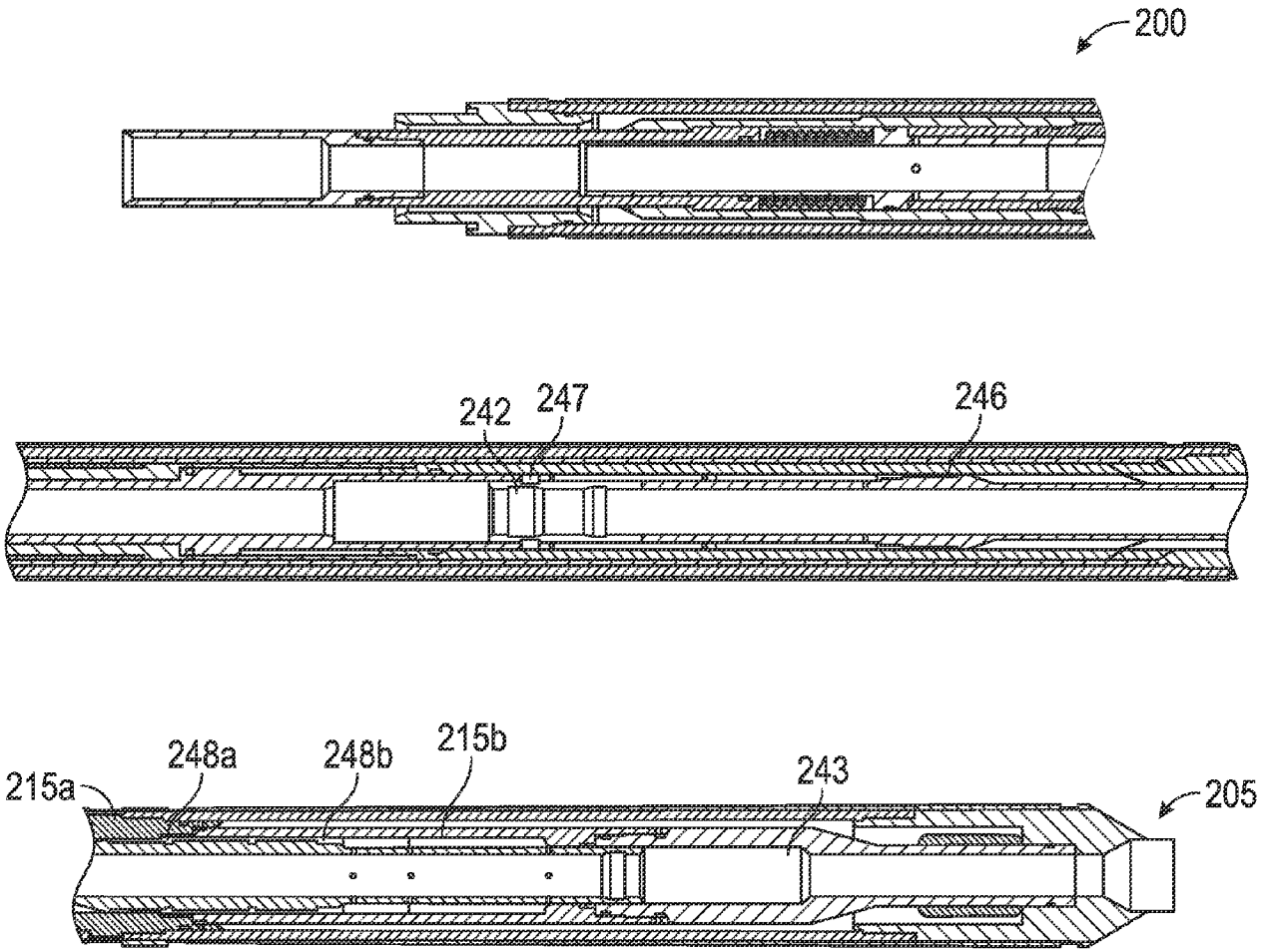
FIG. 3 shows the cross-section of the annular valve of FIG. 2 after the annular valve has been mechanically closed.

FIG. 3 shows the flow device 200 closed, i.e., when the annular flow path 200 is closed. Referring now to FIGS. 2 and 3, to close the annular flow path 220 from the open position shown in FIG. 2, a shifting tool (not shown) is conveyed into the bore 204 of the valve 200 and engaged with or latched onto the upper latch profile 242 of the valve mandrel 240. The shifting tool is then pulled or moved uphole (to the left in FIG. 2), which moves the valve mandrel 240 along with seals 246, 248*a* and 248*b* uphole. The seal 248*a* moves within or into the lower end of the upper housing 215*a*. The seal 248*b* remains within or in the lower valve housing 215*b*. Dogs 247 contained within an indexing sleeve 275 prevent valve mandrel 240 to move further to the left, as shown in FIG. 3. In the particular configuration shown in FIG. 2, the upper latch profile 242 is on the internal diameter of the valve mandrel 240. The outer diameter of the valve mandrel 240 has a shoulder 299*a* that contracts the dogs 247 to prevent further movement of the valve mandrel 240. An additional set of dogs (not shown) may be provided to lock out the indexing sleeve after hydraulic actuation to aid the assembly and disassembly of the expansion tool. In valve mandrel 240 position shown in FIG. 3, seal 246 is within the upper valve housing 215*a* isolating tubing and annulus pressure (i.e., central flow path 204 from annular flow path 220). Seals 248*b* and 248*a* isolate lower annulus pressure from upper annulus pressure and close the annular bypass 230, thereby preventing fluid communication between the annular flow path section 220*b* and 22*b*, thus closing the annular flow path 220, as shown in FIG. 3.

Still referring to FIGS. 2 and 3, in one aspect, the closed annular flow path 220 may be opened mechanically by a shifting tool conveyed from the surface. The shifting tool (not shown) engages or attaches to the lower latch profile 243 and pushes the valve mandrel 240 downhole (to the right in FIG. 3) to move the seal 248*a* out of the annular bypass 230 and to cause the valve mandrel to shoulder out in the lower flow sub 205, as shown in FIG. 2. Mechanically opening the annular flow path 220 requires a separate trip into the wellbore. In another aspect, the annular flow path 220 may be opened hydraulically by applying a hydraulic pressure to the annular flow path 220 from the surface, as described below.

Figure 4:
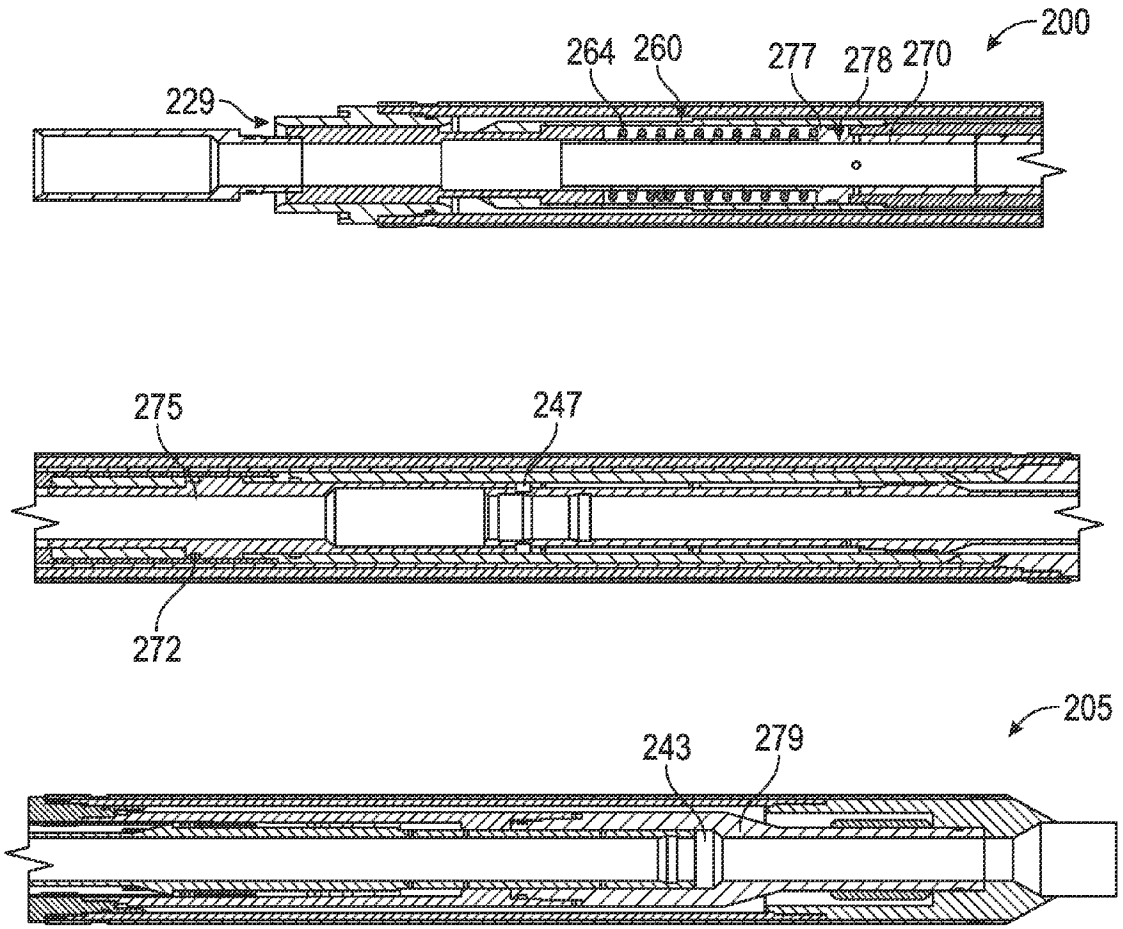
FIG. 4 shows the cross-section of the annular valve of FIG. 3 after the annular valve has been hydraulically opened using annular pressure.

FIG. 4 shows the valve 200 after it has been hydraulically opened by the hydraulic mechanism 260 shown in FIG. 2. Referring now to FIGS. 1-4, in operation, the valve 200 is conveyed in the wellbore with the annular flow 220 open, as shown in FIG. 2. The annular valve 200 is then closed as shown in FIG. 3 and then pressure tested. The valve 200 is then opened hydraulically by the hydraulic device 260. In one aspect, the annular valve 200 may be pressure tested by supplying a fluid from the surface at a first pressure and then opened by activating the hydraulic opening device 260 at a second pressure. For example, the valve 200 may be configured to be pressure tested at first pressure (P1) and configured to be opened at a second pressure (P2) that is greater than the first pressure. The hydraulic device 260, in one aspect, includes a piston 270 and a biasing member, such as spring 264, and the indexing sleeve 275. The indexing sleeve 275 includes dogs 247. The piston 270 is held in its initial position (unreleased position) by a shear pin 272 and is biased by the spring 264. A port 277 provides fluid communication between the annular flow path 220*a* and the piston 270. When a fluid 229 under pressure is supplied to the annular flow path 220, for example from a surface location, fluid 229 acts on the piston 270 via port 277, as shown by arrows 278, which causes the piston 270 to move downhole (to the right), moving or shifting the indexing sleeve 275 to the right. The piston 270 and thus the indexing sleeve 275 will move or shift to the right, shearing the shear pin 272. The piston 270 and the indexing sleeve 275 will continue to move to the right, causing the dogs 247 to move the valve mandrel 240 to move to the right. The valve mandrel 240 will continue to move to the right until the lower latch profile 243 abuts against the mechanical stop 279 in the valve lower flow sub 205 as shown in FIG. 4, which is the same position as shown in FIG. 1. Moving the valve mandrel 240 to the right moves the seal 248*a* away from the annular bypass 230, which opens the annular bypass 230 and thus establishes fluid communication between the upper annular fluid path 220*a* and the lower annular fluid flow path 220*b*, thereby opening the annular fluid flow path 220.

In another aspect, the valve 200 may be run in a wellbore with the annular flow path 220 closed, i.e., in the configuration shown in FIG. 2. In such a case, the valve 200 may be first pressure tested and then hydraulically opened as described above in reference to FIGS. 3 and 4.

In aspects, the disclosure herein provides a fluid flow device that in one aspect includes first flow path that enables continuous flow of fluid therethrough and a second annular flow path that may be selectively opened and closed downhole. In one aspect, the flow device includes a mechanical device for closing and opening the valve and a hydraulic device for opening the annular flow path downhole. The flow device may be run in the wellbore open (in open position or open state), i.e., with annular flow path open, or closed (closed position or closed state), i.e., with annular flow path closed. This allows an operator the flexibility of running a string in the wellbore with the multiple flow path devices either open or closed, based on the particular application. Often, it is desirable to utilize the flow device disclosed herein in a string or assembly for deployment in a wellbore that includes another valve below or downhole of the flow device, which valve controls the flow of the fluid from a particular production zone into the string and thus through the first through flow path in the flow device. If the annular flow path 220 is open when it is run in the wellbore, it will provide a fluid bypass for the fluid in the wellbore from below the flow device to a location above the flow device and thus allow an operator to close the valve below the annular valve during running in of the string 100 or the assembly 110 into the wellbore. In a completion string, such as sting 100 shown in FIG. 1, various valves (flow paths) are typically actuated with tubing pressure, such as pressure applied via the first through flow path shown in FIG. 2. Actuating the annular flow path with the annulus pressure, as described in reference to FIGS. 2 and 3 above, prevents accidentally opening the annular flow path when tubing pressure is applied to actuate one or more other devices in the string.

The invention claimed is:

1. A flow control device for use in a wellbore, comprising:

a first device that includes a bore providing a first flow path for flow of a first fluid from a first production zone;

a second flow path in an annulus around the first device providing a flow path for a second fluid from a second production zone, the second flow path including an upper annular flow path, a lower annular flow path and an annular bypass between the lower annular flow path and the upper annular flow path, wherein the first device is movable between a first position that opens the annular bypass and a second position that closes the annular bypass; and a second device disposed outside the annular bypass, that moves the first device from the second position to the first position when hydraulic pressure is applied to the annulus to open the second flow path.

2. The flow control device of claim 1, wherein the first device is mechanically-operated to close the second flow path.

3. The flow control device of claim 1, wherein the first device is configured to be operated by a mechanical device conveyed from a surface location.

4. The flow control device of claim 1 further comprises a valve housing disposed inside an outer housing to provide the annulus.

5. The flow control device of claim 4, wherein the first device includes a movable member that in a first position opens the annular bypass and in a second position closes the annular bypass.

6. The flow control device of claim 5, wherein the first device further includes seals that move with the movable member and provide a seal between the second flow path and the movable member.

7. The flow control device of claim 1, wherein the second device includes a piston operated by the hydraulic pressure applied to the annulus to move the first device from the second position to the first position to open the second flow path.

8. The flow control device of claim 1, wherein the first device includes a profile configured to be engaged with a shifting tool conveyed from a surface location to move the first device from the first position to the second position and from the second position to the first position.

9. A production string for placement in a wellbore, comprising:

a first inflow device at a first location to allow fluid from a first zone into a first tubular and a second inflow device to allow fluid from a second zone into a space between the first tubular and a second tubular;

a flow control device in the string that includes:

a first device that includes a bore providing a first flow path to allow flow of the fluid from the first zone therethrough;

a second flow path in an annulus around the first device providing a flow path for the fluid from the second production zone, the second flow path including an upper annular flow path, a lower annular flow path and an annular bypass between the lower annular flow path and the upper annular flow path, wherein the first device is movable between a first position that opens the annular bypass and a second position that closes the annular bypass; and a second device disposed outside the annular bypass, that moves the first device from the second position to the first position when hydraulic pressure is applied to the annulus to open the second flow path.

10. The production string of claim 9, wherein the first device includes a movable member that in a first position opens the annular bypass and in a second position closes the annular bypass.

11. The production string of claim 10, wherein the first device further includes seals that move with the movable member and provide a seal between the second flow path and the movable member.

12. The production string of claim 9 further comprising a valve housing disposed inside an outer housing to provide the annulus.

13. The production string of claim 9, wherein the first device is configured to be operated by a mechanical device conveyed from a surface location.

14. The production string of claim 9, wherein the second device includes a piston operated by the hydraulic pressure applied to the annulus to move the first device from the second position to the first position to open the first flow path.

15. The flow control device of claim 9, wherein the first device includes a profile configured to be engaged with a shifting tool conveyed from a surface location to move the first device from the first position to the second position and from the second position to the first position.

16. A method of producing fluid from a plurality of zones, the method comprising:

conveying a string in a wellbore that includes a first tubular and a second tubular inside the first tubular, wherein the string includes a flow control device that includes: a first device that includes a bore providing a first flow path to flow a first fluid from a first zone therethrough; a second flow path in an annulus around the first device to flow a second fluid from a second zone, the second flow path including an upper annular flow path, a lower annular flow path and an annular bypass between the lower annular flow path and the upper annular flow path, wherein the first device is movable between a first position that opens the annular bypass and a second position that closes the annular bypass; and a second device disposed outside the annular bypass, that moves the first device from the second position to the first position when hydraulic pressure is applied to the annulus to open the second flow path;

moving the first device in the second position to close the annular bypass of the second flow path;

pressure testing the flow control device;

moving the first device to the first position to open the annular bypass of the second flow path by applying a fluid under pressure to the annulus; and producing the first fluid from the first zone through the first flow path and producing the second fluid from the second zone through the second flow path.

17. The method of claim 16, wherein opening the second flow path comprises opening the annular bypass by the supplying the fluid under pressure to the annulus.

18. A flow control device for use in a wellbore, comprising:

a first device that includes a bore providing a first flow path providing a flow path for flow of a first fluid from a first production zone;

a second flow path along an annulus around the first device providing a flow path for a second fluid from a second production zone, the second flow path including an upper annular flow path, a lower annular flow path and an annular bypass between the lower annular flow path and the upper annular flow path; and wherein the annular bypass of the second flow path opens upon application of a selected pressure to the annulus via a second device disposed outside the annular bypass to move the first device.

19. The apparatus of claim 18, wherein:

the first device opens the annular bypass of the second flow path in a first position and in a second position closes the annular bypass of the second flow path in a second position;

wherein the second device moves the first device from the second position to the first position when hydraulic pressure is applied to the annulus to open the second flow path.

* * * * *